US008181399B2

(12) United States Patent
Knight, III et al.

(10) Patent No.: US 8,181,399 B2
(45) Date of Patent: May 22, 2012

(54) STABILITY BRACING OF A SUPPORT STRUCTURE FOR ELEVATING A BUILDING STRUCTURE

(75) Inventors: Stephen J. Knight, III, Littleton, CO (US); William E. Kugler, Denver, CO (US)

(73) Assignee: United Construction Products, Inc., Denver, CO (US)

( * ) Notice: Subject to any disclaimer, the term of this patent is extended or adjusted under 35 U.S.C. 154(b) by 170 days.

(21) Appl. No.: 12/505,217

(22) Filed: Jul. 17, 2009

(65) Prior Publication Data

US 2011/0011012 A1 Jan. 20, 2011

(51) Int. Cl.
*E04B 9/00* (2006.01)

(52) U.S. Cl. ..... 52/126.6; 52/126.1; 52/126.4; 52/126.7; 52/220.1; 52/263

(58) Field of Classification Search ..... 52/126.1, 52/126.4, 126.6, 126.7, 241, 220.1, 263; 248/188.4

See application file for complete search history.

(56) References Cited

U.S. PATENT DOCUMENTS 3,425,179 A * 2/1969 Haroldson ..... 52/283
3,923,277 A * 12/1975 Perrault et al. ..... 248/49
4,085,557 A * 4/1978 Tharp ..... 52/263
4,277,923 A * 7/1981 Rebentisch et al. ..... 52/126.6
4,558,544 A * 12/1985 Albrecht et al. ..... 52/126.6
4,736,555 A * 4/1988 Nagare et al. ..... 52/126.6
4,773,196 A * 9/1988 Yoshida et al. ..... 174/486
4,780,571 A * 10/1988 Huang ..... 174/484
4,905,437 A * 3/1990 Heather ..... 52/263
4,996,804 A * 3/1991 Naka et al. ..... 52/126.6
5,333,423 A * 8/1994 Propst ..... 52/126.6
5,389,737 A * 2/1995 Kobayashi et al. ..... 174/483
5,398,466 A 3/1995 Oyama et al.
5,400,554 A * 3/1995 Lo ..... 52/126.5
5,467,609 A * 11/1995 Feeney ..... 62/259.2
5,479,745 A * 1/1996 Kawai et al. ..... 52/126.6
5,588,264 A * 12/1996 Buzon ..... 52/126.6
5,791,096 A * 8/1998 Chen ..... 52/126.6
5,862,635 A 1/1999 Linse et al.
5,904,009 A * 5/1999 Huang ..... 52/126.6
5,946,867 A 9/1999 Snider, Jr. et al.
6,332,292 B1 * 12/2001 Buzon ..... 52/126.6
6,363,685 B1 * 4/2002 Kugler ..... 52/745.05
6,370,831 B1 * 4/2002 Marshall et al. ..... 52/263
6,442,906 B1 * 9/2002 Hwang ..... 52/126.6
6,684,582 B2 * 2/2004 Peart et al. ..... 52/220.1

(Continued)

OTHER PUBLICATIONS

Bison Deck Supports, Bracing Specifications Brochure (Dec. 2005).

(Continued)

*Primary Examiner* — Brian Glessner
*Assistant Examiner* — Joshua Ihezie
(74) *Attorney, Agent, or Firm* — Marsh Fischmann & Breyfogle LLP

(57) ABSTRACT

A support structure for elevating a building surface above a fixed surface having stability bracing to provide increased stability to the structure. The support structure includes a plurality of support pedestals that are disposed in spaced-apart relation on a fixed surface. A plurality of braces are attached to adjacent support pedestals to interconnect the support pedestals. Interconnecting the support pedestals in such a manner creates a stable support structure that can be utilized in unstable environments, such as seismically active geographic areas. The support pedestals can be adjustable-height support pedestals.

23 Claims, 13 Drawing Sheets

U.S. PATENT DOCUMENTS

| | | | | |
|---|---|---|---|---|
| 6,772,564 | B2 * | 8/2004 | Leon | 52/126.5 |
| 6,857,230 | B2 * | 2/2005 | Owen | 52/126.6 |
| 6,983,570 | B2 * | 1/2006 | Mead | 52/263 |
| RE39,097 | E * | 5/2006 | Schilham | 52/263 |
| 7,140,156 | B1 * | 11/2006 | Lowe et al. | 52/263 |
| 7,360,343 | B1 * | 4/2008 | Spransy et al. | 52/263 |
| 7,373,759 | B1 * | 5/2008 | Simmons | 52/220.5 |
| 7,454,869 | B2 * | 11/2008 | Owen | 52/263 |
| 7,509,782 | B2 * | 3/2009 | Colosimo et al. | 52/792.1 |
| 2001/0011441 | A1 * | 8/2001 | Jette | 52/220.1 |
| 2001/0034987 | A1 * | 11/2001 | Cooper et al. | 52/220.8 |
| 2002/0003194 | A1 * | 1/2002 | Simmons | 248/49 |
| 2002/0026757 | A1 * | 3/2002 | Scissom et al. | 52/220.2 |
| 2002/0078638 | A1 * | 6/2002 | Huang | 52/126.6 |
| 2002/0148173 | A1 * | 10/2002 | Kugler | 52/126.6 |
| 2003/0070372 | A1 * | 4/2003 | Favero | 52/220.1 |
| 2004/0035064 | A1 * | 2/2004 | Kugler et al. | 52/126.6 |
| 2004/0055232 | A1 * | 3/2004 | Jette | 52/220.1 |
| 2004/0074170 | A1 * | 4/2004 | Huang | 52/220.1 |
| 2004/0261329 | A1 * | 12/2004 | Kugler et al. | 52/126.6 |
| 2005/0284040 | A1 | 12/2005 | Hashimoto et al. | |
| 2008/0053017 | A1 | 3/2008 | Hockemeyer et al. | |
| 2008/0053018 | A1 | 3/2008 | Hockemeyer et al. | |
| 2008/0105172 | A1 | 5/2008 | Repasky | |
| 2008/0222973 | A1 * | 9/2008 | Lee et al. | 52/126.1 |
| 2009/0183442 | A1 * | 7/2009 | Repasky | 52/126.6 |
| 2009/0188189 | A1 * | 7/2009 | Repasky | 52/291 |
| 2011/0011012 | A1 | 1/2011 | Knight, III et al. | |
| 2011/0023385 | A1 | 2/2011 | Knight, III et al. | |

OTHER PUBLICATIONS

Bison Deck Supports, Bracing Specifications and Design Requirements Brochure (2003).

Bison Deck Supports, Banded Bracing Specification Brochure (Feb. 2006).

Bison ScrewJack Specification Brochure (2003).

* cited by examiner

STABILITY BRACING OF A SUPPORT STRUCTURE FOR ELEVATING A BUILDING STRUCTURE

BACKGROUND OF THE INVENTION

1. Field of the Invention

This invention relates to the field of support structures for supporting an elevated surface above a fixed surface, such as for elevated floors, decks and walkways.

2. Description of Related Art

Elevated building surfaces such as elevated floors, decks, terraces and walkways are desirable in many environments. One common system for creating such surfaces includes a plurality of surface tiles, such as concrete tiles (pavers), stone tiles or wood tiles, and a plurality of spaced-apart support pedestals upon which the tiles are placed to be supported above a fixed surface. For example, in outdoor applications, the surface may be elevated above a fixed surface by the support pedestals to promote drainage, to provide a level structural surface for walking, and/or to prevent deterioration of or damage to the surface tiles. The pedestals can have a fixed height, or can have an adjustable height such as to accommodate variations in the contour of the fixed surface upon which the pedestals are placed, or to create desirable architectural features.

Although a variety of shapes are possible, in many applications the surface tiles are rectangular in shape, having four corners. In the case of a rectangular shaped tile, each of the spaced-apart support pedestals can therefore support four adjacent surface tiles at the tile corners. Stated another way, each rectangular surface tile can be supported by four pedestals that are disposed under each of the corners of the tile. Large or heavy tiles can be supported by additional pedestals at positions other than at the corners of the tiles.

One example of a support pedestal is disclosed in U.S. Pat. No. 5,588,264 by Buzon, which is incorporated herein by reference in its entirety. The support pedestal disclosed by Buzon can be used in outdoor or indoor environments and is capable of supporting heavy loads applied by many types of building surfaces. The pedestal includes a threaded base member and a threaded support member that is threadably engaged with the base member to enable the height of the support pedestal to be adjusted by rotating the support member or the base member relative to the other. The support pedestal can also include a coupler member disposed between the base member and the support member for further increasing the height of the pedestal, if necessary.

Support pedestals are also disclosed in U.S. Pat. No. 6,363,685 by Kugler and U.S. Patent Publication No. 2004/0261329 by Kugler et al., each of which is also incorporated herein by reference in its entirety.

SUMMARY OF THE INVENTION

One problem that is associated with some support structures for elevated surfaces is that the support structures do not provide adequate structural stability in certain unstable environments. As a result, the support structures cannot be safely utilized in certain seismically active geographic areas or other locations that may be subject to disruptive vibrations of the fixed surface. This can be a particular problem when the support pedestals themselves are not affixed to the underlying surface and therefore do not move in unison with movement of the underlying surface.

Another problem associated with some support structures for elevated surfaces is that the safely obtainable height of the support pedestals is limited due to the increasing instability of the support pedestals as the height of the pedestals, and hence the center of gravity of the pedestals, is increased. The increased height of the center of gravity further compounds the problems associated with disruptive vibrations of the underlying surface.

It is therefore an objective to provide a support structure for an elevated surface, where the support structure has improved structural stability. It is also an objective to provide a support structure that can enable the safe construction of an elevated surface having an increased height above the fixed surface as compared to existing support structures, particularly in areas that are prone to disruptive vibrations.

In one exemplary embodiment, a support structure for elevating a building surface above a fixed surface is provided. The support structure can include a plurality of support pedestals that are disposed in spaced-apart relation on a fixed surface. The support pedestals can include a base member that is adapted to be placed upon the fixed surface and a support plate disposed over the base member. A plurality of braces are each operatively attached to at least two adjacent support pedestals to interconnect the support pedestals and form a stable support structure. In this regard, a plurality of pedestal attachment elements can be disposed around a perimeter of the support pedestal, and the braces can include brace attachment elements disposed in end portions of the braces such that the brace attachment elements can be secured to the pedestal attachment elements to secure the braces to the support pedestals.

In one aspect, the brace attachment elements comprise attachment knobs and the pedestal attachment elements comprise apertures, wherein the attachment knobs are disposed through the apertures to secure the braces to the support pedestals. In another aspect, the brace attachment elements comprise apertures and the pedestal attachment elements comprise attachment knobs, where the attachment knobs are disposed through the apertures to secure the braces to the support pedestals.

The support pedestals can have a fixed height, and in one aspect the support pedestals can have an adjustable height. In another aspect, the braces can include arcuate end portions that are attached to the support pedestals. The arcuate end portions can each comprise at least one brace attachment element such as an aperture.

According to another aspect, one or more of the braces can have an adjustable length. Adjustable length braces can be particularly advantageous to accommodate the use of surface tiles having edge portions of different lengths, e.g., rectangular tiles that are not square.

According to another aspect, the pedestal attachment elements are disposed around a perimeter of the pedestal base members. For example, the pedestal attachment elements can be disposed around a base plate that forms the bottom surface of the base member. In this regard, the attachment elements can include attachment knobs that are permanently or removably affixed to the base member.

In another aspect, the pedestal attachment elements can be disposed on a stabilizing collar that is operatively attached to the support pedestal. For example, the stabilizing collar can be threadably attached to the support pedestal whereby the height of the stabilizing collar can be adjusted. In one aspect, the pedestal attachment elements disposed on the stabilizing collar include attachment knobs.

In one aspect, the support pedestals are not attached to the fixed surface. For example, the fixed surface can be natural ground or another surface that is not amenable to the attachment of the support pedestals to the fixed surface. In another aspect, the support pedestals are non-metallic support pedestals, such as plastic support pedestals that are resistant to rotting and corrosion due to exposure to outdoor environments. The braces can be fabricated from a variety of materials, preferably non-metallic materials such as plastic, wood and composite materials, e.g., fiber reinforced plastics.

According to another embodiment, a support structure for elevating a building surface above a fixed surface is provided. The support structure can include a plurality of height-adjustable support pedestals that are disposed in spaced-apart relation, the support pedestals including a base member that is adapted to be placed upon a fixed surface and a support plate disposed over the base member that is adapted to support a surface tile above the fixed surface. A plurality of attachment knobs are operatively disposed around the perimeter of the support pedestals and a plurality of braces are operatively attached to the support pedestals to interconnect the support pedestals. The braces can include end portions having at least one aperture, wherein the attachment knobs are disposed within the apertures to secure the braces to the support pedestals.

In one aspect, the attachment knobs can be disposed around the perimeter of the base member. In another aspect, the height-adjustable support pedestals can include a support member comprising a support plate, where the support member is threadably connected to the base member. In yet another aspect, the height adjustable support pedestals can include a coupling member operatively connecting the base member and a support member.

According to another aspect, the attachment knobs can be disposed on a stabilizing collar that is threadably attached to the support pedestal. In yet another aspect, the braces can have an adjustable length.

According to another embodiment, an elevated building surface assembly is provided. The assembly can include a plurality of support pedestals that are disposed in spaced-apart relation. The support pedestals can include a base member that is adapted to be placed upon a fixed surface and a support member that is disposed over and threadably connected to the base member. A plurality of braces can be attached to adjacent support pedestals to interconnect the support pedestals and form a stable support structure and a plurality of surface tiles can be placed upon the support members to form the elevated building surface. According to one aspect, the attachment knobs are disposed on a stabilizing collar that is threadably connected to the support pedestal. According to another aspect, the attachment knobs are disposed around a perimeter of the base member. According to yet another aspect, the braces have an adjustable length.

According to another embodiment, a method for constructing an elevated building surface comprising a plurality of surface tiles is provided. The method can include the steps of placing a plurality of height-adjustable support pedestals on a fixed surface in a spaced-apart relationship, the pedestals each including a base member. The support pedestals can be interconnected by attaching a brace to adjacent support pedestals. Surface tiles can be placed on the support pedestals to form the elevated building surface. According to one aspect, the fixed surface can have a sloped or otherwise uneven topography. According to another aspect, the step of attaching the brace can include placing at least one aperture in an end portion of the brace through an attachment knob that is disposed on a perimeter of the support pedestals.

In accordance with the foregoing embodiments and aspects, the support structure can provide increased structural stability. In one aspect, the support structure can be used to support elevated surfaces in seismically active geographic areas. Through interconnection of the support pedestals, the support pedestals can move in unison during a seismic event or other disruption to maintain the desired spacing between the support pedestals, and therefore continue to safely support surface tiles placed on the support pedestals and maintain the integrity of the building surface.

The support structure can have an increased structural stability, thereby enabling the use of support pedestals having an increased height without adversely affecting the stability of the elevated surface. For example, the support pedestals can have a height of greater than 24 inches and even up to about 36 inches or more.

The braces can be rapidly and easily attached to the support members during construction of the support structure. The braces can also be configured to prevent twisting of the support pedestals in relation to adjacent support pedestals.

DESCRIPTION OF THE INVENTION

Figure 1:
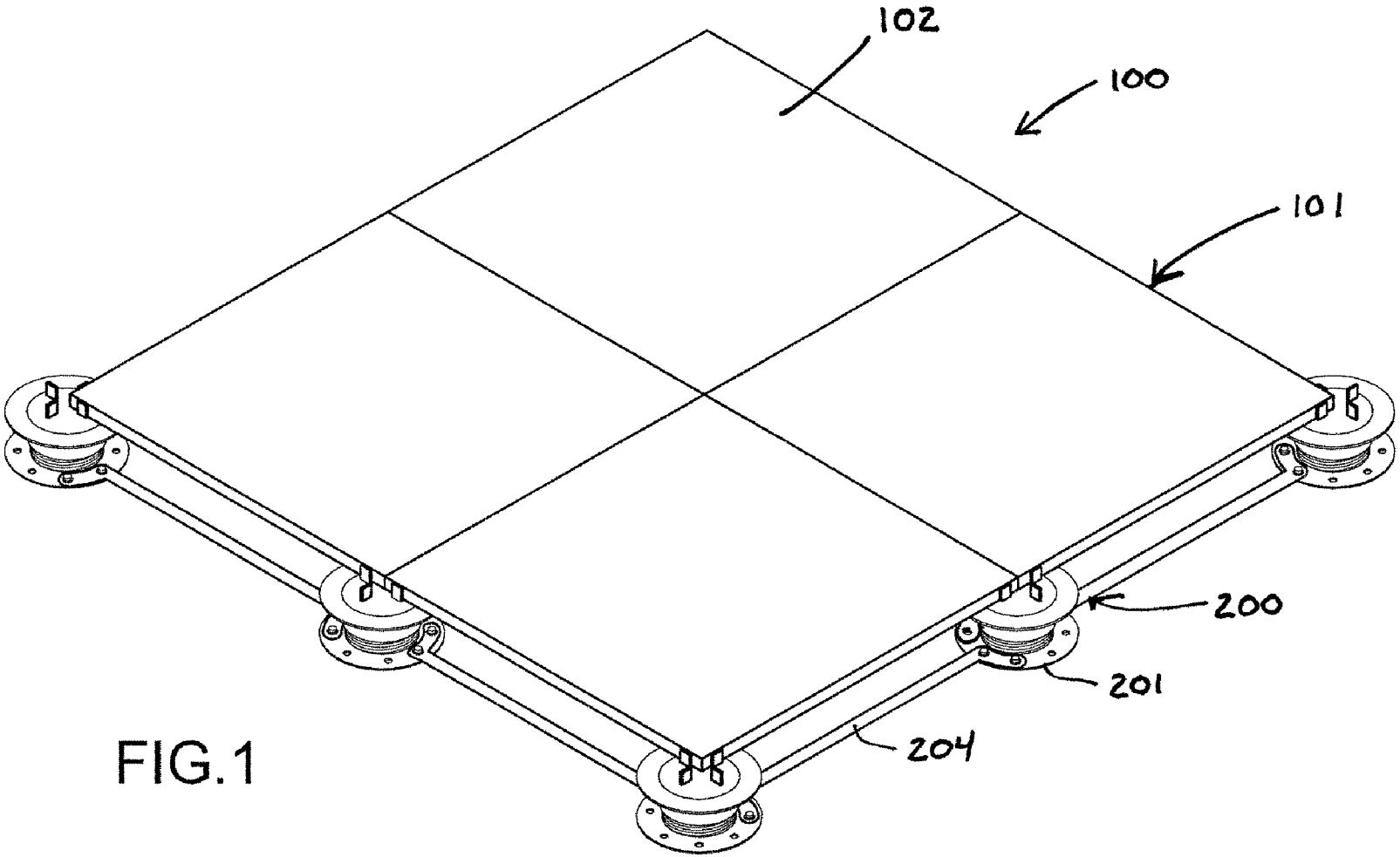
FIG. 1 illustrates a perspective view of a stabilized elevated building surface assembly.

FIG. 1 illustrates a portion of an elevated building surface assembly 100 that includes a building surface 101 formed from a plurality of surface tiles 102. The surface tiles 102 are elevated above a fixed surface by a support structure 200 comprising a plurality of spaced-apart support pedestals 201 and a plurality of braces 204 interconnecting the support pedestals. The surface tiles 102 can be comprised of virtually any material from which a building surface is constructed. Examples include, but are not limited to, slate tiles, natural stone tiles, composite tiles, concrete tiles (e.g., pavers), wooden deck tiles, particularly hardwood deck tiles, tiles of metal or fiberglass grating, and the like. The support pedestals 201 can be placed in a spaced-apart relationship on fixed surfaces including, but not limited to, rooftops, on-grade (e.g., natural ground), over concrete slabs including cracked concrete slabs, and can be placed within fountains and water features, used for equipment mounts, and the like. The elevated building surface assembly 100 can be used for both interior and exterior applications.

Each of the surface tiles 102 is placed upon several support pedestals 201 to elevate the tile 102 above the fixed surface. As illustrated in FIG. 1, the surface tiles 102 are square and a support pedestal 201 is disposed beneath four corners of adjacent surface tiles 102. Further, although illustrated in FIG. 1 as being laid out in a symmetric square pattern, the support pedestals 201 can also be laid out in various configurations as may be dictated by the shape and size of the surface tiles, such as a rectangular configuration or a triangular configuration.

The support pedestals 201 are interconnected by a plurality of braces 204 that are attached to the support pedestals 201 and operatively connect each support pedestal with one or more adjacent support pedestals to form a stable support structure 200. The braces 204 interconnecting the support pedestals 201 can advantageously enhance the stability of the support structure 200 as compared to a structure utilizing support pedestals that are not interconnected and are free to move independently with respect to other support pedestals. For example, if one or more of the support pedestals 201 shift, such as during a seismic event or other disruption, the braces 204 will cause the interconnected support pedestals 201 to move essentially in unison such that the spacing between adjacent support pedestals remains substantially fixed. Therefore, the surface tiles 102 will remain supported above the fixed surface and the integrity of the building surface 101 will be maintained. Preferably, neither the braces 204 nor the support pedestals 201 are attached to the fixed surface.

Figure 2:
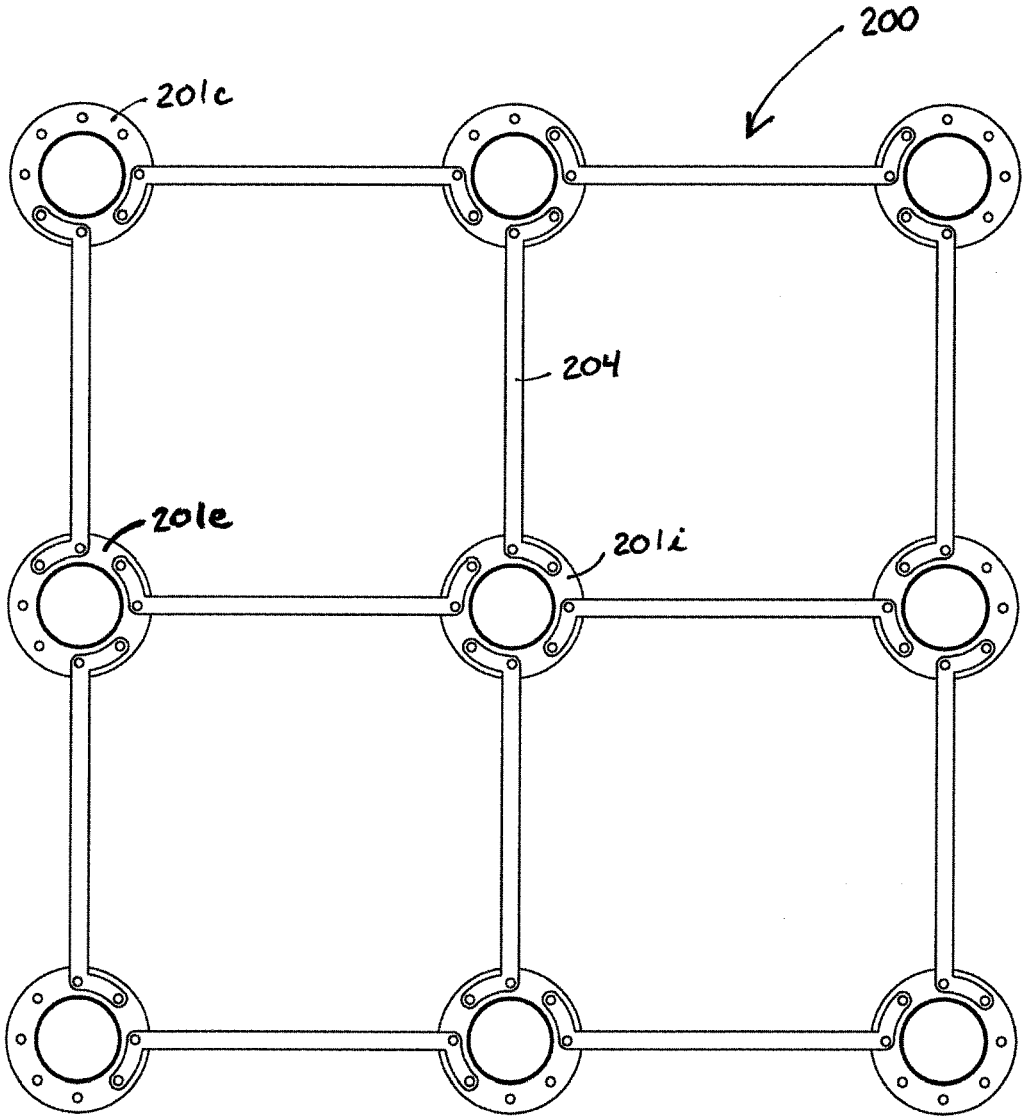
FIG. 2 illustrates a top view of a stable support structure for elevating a surface.

FIG. 2 illustrates a top view of a support structure 200 for elevating a building surface. The support structure 200 includes a plurality of support pedestals 201 that are spaced-apart by a predetermined distance. The placement of the support pedestals 201 will be dictated by shape and size of the surface tiles that are placed on the support structure 200. By way of example, the distance between adjacent support pedestals, such as pedestal 201*e* and 201*i*, can typically be from about 1 foot to about 3 feet, such as about 2 feet. As is discussed below, the braces can optionally have an adjustable length, such as to accommodate the use of surface tiles having edges of different lengths A plurality of braces 204 are attached to and interconnect the support pedestals 201. For example, each brace 204 can operatively connect two adjacent support pedestals 201. As illustrated in FIG. 2, each interior support pedestal, such as support pedestal 201*i*, is connected by a brace 204 to each nearest adjacent support pedestal. Thus, each interior support pedestal 201*i* can be interconnected to four nearest adjacent support pedestals using four individual braces 204. Exterior support pedestals located on the perimeter of the support structure 200 may be attached to fewer than four support pedestals, such as support pedestal 201*e*, which is interconnected to three adjacent support pedestals. In a similar fashion, corner support pedestals such as support pedestal 201*c* may be interconnected to two adjacent support pedestals. Although FIG. 2 illustrates that braces 204 are disposed between and attached to nearest adjacent support pedestals, the braces 204 could also be disposed to interconnect adjacent support pedestals that are diagonally opposed, such as corner support pedestal 201*c* and interior support pedestal 201*i*.

The support structure 200 comprising the support pedestals 201 interconnected with braces 204 can advantageously provide enhanced stability for the elevated building surface. For example, the support structure 200 can be used in seismically active geographic areas to improve the stability of the elevated building surface during seismic events. In this regard, the braces 204 can cause the support pedestals 201 to move essentially in unison, thereby maintaining the required spaced-apart relationship between support pedestals to keep the surface tiles supported. Such a stable structure may also be desired in other locations that are subject to periodic vibrations, such as a train platform.

The utilization of such braces 204 to interconnect the support pedestals 201 can also increase the safely obtainable height of the support pedestals. That is, the braces 204 can provide sufficient structural stability such that support pedestals 201 having a higher center of gravity can be safely utilized to elevate the building surface without undue risk of the building surface collapsing.

The braces 204 are therefore adapted to interconnect the support pedestals 201 and provide a sufficiently rigid lateral connection between the support pedestals such that the support pedestals move in unison, and such that the spacing among the support pedestals does not substantially change due to seismic events or other events that can cause movement of the support pedestals. In one embodiment, the braces 204 can also be sufficiently flexible to permit the braces to be placed over surfaces that are not completely flat while maintaining a rigid lateral connection among the support pedestals.

The braces 204 can have a variety of sizes, shapes and configurations. FIGS. 3*a*-3*d* illustrate several exemplary embodiments of braces 204 that can be utilized to interconnect support pedestals in a support structure. Each of the braces 204 includes end portions 206 at opposite ends of an elongate central portion 207. The end portions 206 are adapted to be connected to a support pedestal, and in this regard can include one or more brace attachment elements adapted to secure the brace to a support pedestal. As illustrated in FIGS. 3*a*-3*d*, the brace attachment elements are apertures 208 for attaching the braces 204 to a support pedestal. Alternatively, the end portions 206 could include other attachment elements for attachment to a support pedestal, such as attachment knobs projecting from the braces 204 or the like.

Figures 3A, 3B, 3C, 3D:
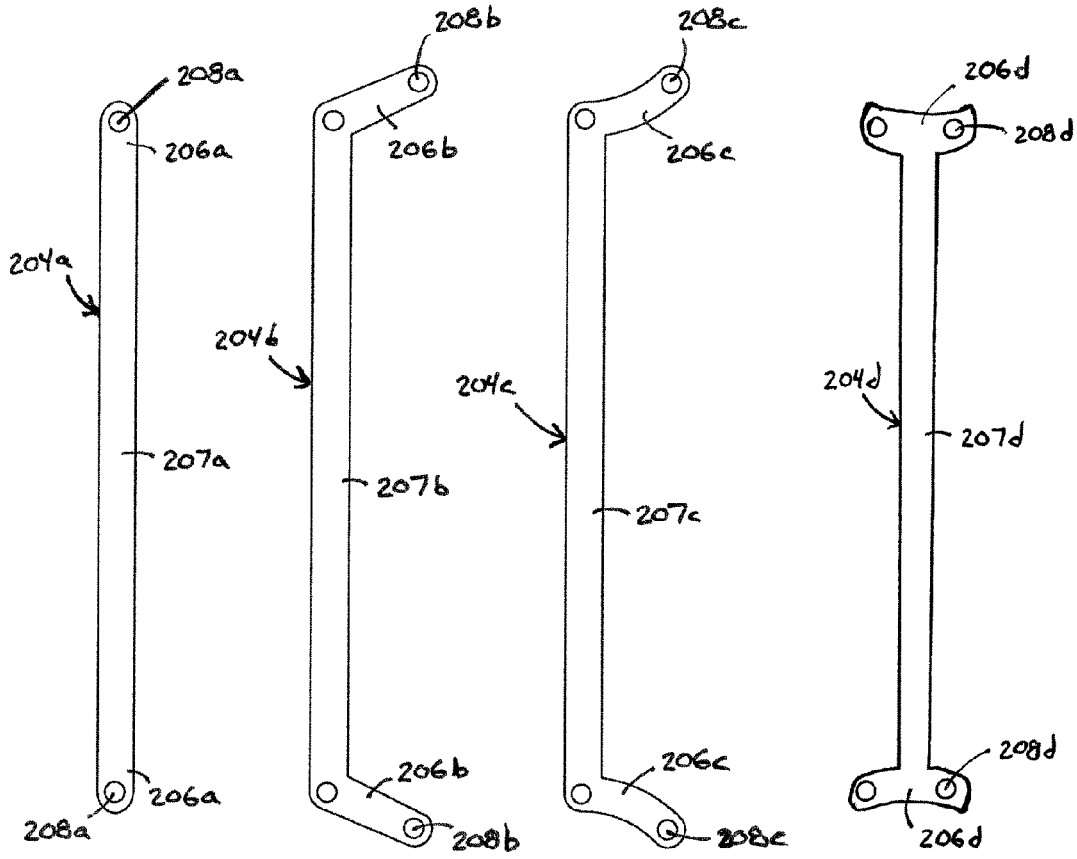
FIGS. 3*a*-3*d* illustrate braces that are adapted to interconnect support pedestals in a support structure for elevating a surface.

FIG. 3*a* illustrates a brace 204*a* where the end portions 206*a* are substantially parallel with an elongate central portion 207*a*. The brace 204*a* includes at least one aperture 208*a* disposed in each end portion 206*a* of the brace. The apertures 208*a* can be adapted to fit over a knob or similar structure on a support pedestal to attach the brace 204*a* to the support pedestal. Although illustrated as including one aperture 208*a* in each end portion 206*a*, each end portion 206*a* can include two or more apertures 208*a* for attachment to a support pedestal.

FIG. 3*b* illustrates a brace 204*b* having oblique end portions 206*b*, i.e., that are angled with respect to the elongate axis of the central portion 207*b*. The oblique end portions 206*b* include two spaced-apart apertures 208*b* for attachment to a support pedestal. The brace 204*b* can be useful, for example, when a base member plate of the support pedestal to which the brace is attached has a rectangular (e.g., square)

configuration. In this regard, the end portions 206*b* could also be disposed approximately perpendicular to the elongate axis of the central portion 207*b*.

FIG. 3*c* illustrates a brace 204*c* having arcuate end portions 206*c*. The arcuate end portions 206*c* include apertures 208*c* that are adapted to attach to a support pedestal, such as by placement over knobs on the base member of a support pedestal. A brace 204*c* having arcuate end portions 206*c* can be useful, for example, to interconnect support pedestals having a round or oval base member plate. Although illustrated as including two apertures 208*c*, the arcuate end portions 206*c* can include a single aperture or can include multiple apertures for attaching to a support pedestal, as well as other means for attachment to the support pedestal.

FIG. 3*d* illustrates a brace 204*d* that includes arcuate end portions 206*d*. In the embodiment illustrated in FIG. 3*d*, the end portions 206*d* are substantially perpendicularly oriented with respect to the central portion 207*d*.

The braces illustrated in FIGS. 3*b*-3*d* can be particularly advantageous in that the use of two or more spaced-apart apertures (i.e., more than one attachment element) can advantageously prevent twisting of a support pedestal, particularly with respect to other support pedestals and can form a more rigid and stable structure.

In one embodiment, the braces are elastic and sufficiently flexible to accommodate the placement of the support structure upon uneven fixed surfaces, while maintaining sufficient lateral rigidity to rigidly interconnect the support pedestals. In any respect, the braces 204 can be fabricated from a variety of materials. For example, the braces 204 can be fabricated from non-metallic materials, such as plastics, wood and composite materials. In one exemplary embodiment, the braces have a length of from about 1 foot to about 3 feet, and a thickness of from about ⅛" to about ¾".

Figure 4:
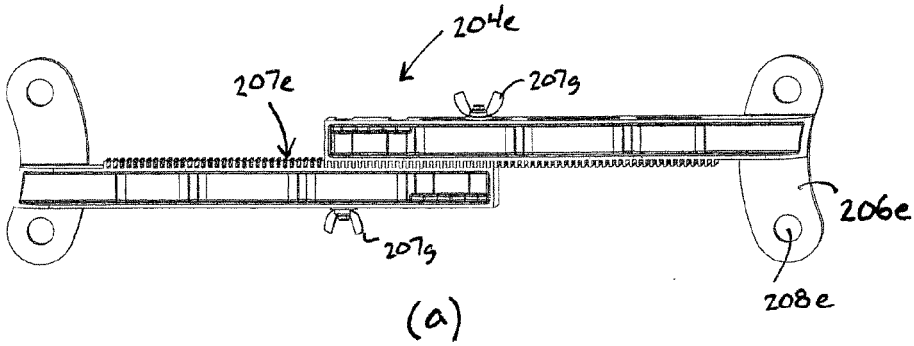
FIGS. 4*a*-4*b* illustrate an adjustable length brace that is adapted to interconnect support pedestals in a support structure for elevating a surface.
Figure 4:
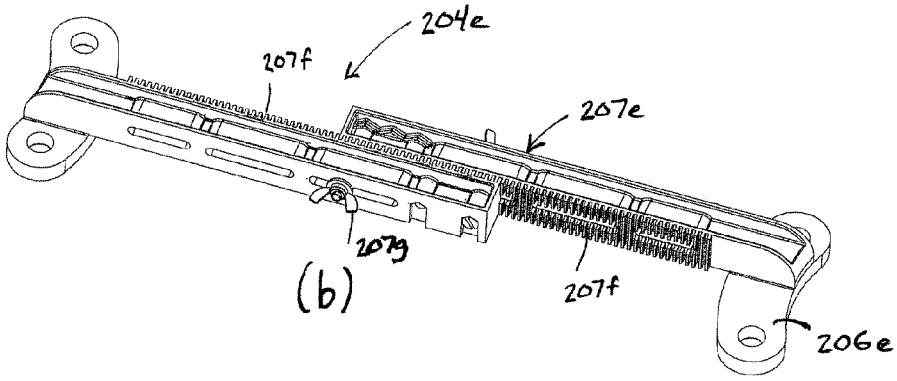

FIGS. 4*a*-4*b* illustrate a brace having an adjustable length. As illustrated in FIGS. 4*a*-4*b*, the adjustable length brace 204*e* includes a central portion 207*e* and end portions 206*e* having apertures 208*e* disposed therein for attachment to a support pedestal. The central portion 207*e* includes mutually opposed toothed racks 207*f* that are adapted to interlock along their length. Thumb screws 207*g* can be used to loosen and tighten the racks 207*f* to permit length adjustment of the brace 204*e*. In this way, the length of the brace 204*e* can be adjusted over a wide range. Other mechanisms for adjusting the length of the braces will be apparent to those skilled in the art.

Thus, braces are utilized to interconnect a plurality of support pedestals to form a support structure that supports the surface tiles to form the elevated building surface. The support pedestals that are useful for forming the support structure can have a variety of configurations. The support pedestals can have a fixed height, or can be height-adjustable support pedestals. Further, any combination of fixed height and height-adjustable support pedestals can be used to form the support structure. The support pedestals can also be fabricated from a variety of materials. Preferably, the support pedestals are fabricated from a non-metallic material, such as plastic that is resistant to rot and corrosion.

Figure 5:
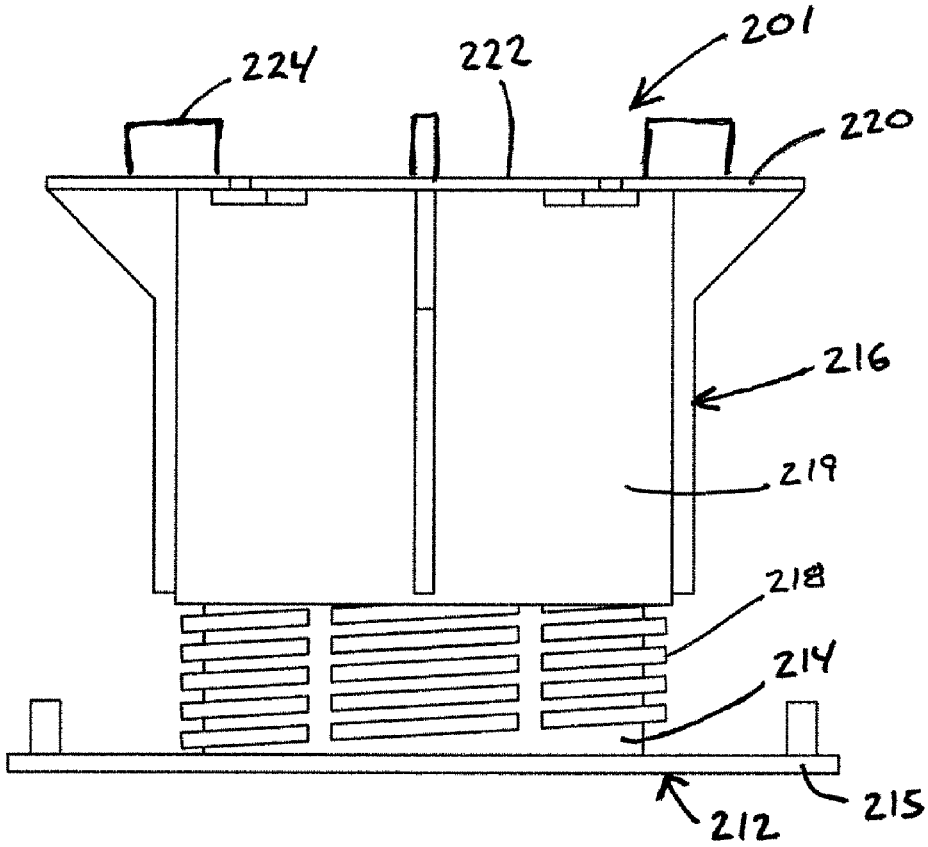
FIG. 5 illustrates a side view of a support pedestal that is useful in a support structure for elevating a surface.

FIG. 5 illustrates a side view of an exemplary support pedestal 201 that includes a base member 212 that is adapted to be placed upon a fixed surface. The support pedestal 201 illustrated in FIG. 5 is a height-adjustable support pedestal. In this regard, the base member 212 includes a cylindrical base member extension 214 that extends upwardly from a base member plate 215 when the support pedestal 201 is operatively placed on a fixed surface. The base member 212 includes base member threads 218 on a surface of the base member extension 214.

A support member 216 is adapted to be operatively connected to the base member 212 and includes a support plate 220 and a cylindrical support member extension 219 that extends downwardly from the support plate 220. The support member 216 includes support member threads (not illustrated) on an interior surface of the support member extension 216 that are adapted to threadably engage base member threads 218 to connect the support member 216 to the base member 212. Thus, the support member 216 can be mated directly to base member threads 218 and can be rotated relative to the base member 212 to adjust the height of the support pedestal 201. The support plate 220 is thereby disposed above the base member 212 to support surface tiles thereon. Although illustrated as having internal threads on the support member 216 and external threads on the base member 218, it will be appreciated that other configurations are possible, including external threads on the support member and internal threads on the base member. See, for example, U.S. Pat. No. 5,588,264 by Buzon and U.S. Pat. No. 6,363,685 by Kugler, each of which is incorporated herein by reference in its entirety. The support pedestal could also have a fixed height.

The support plate 220 includes a top surface 222 upon which the corners of adjacent surface tiles can be placed. Spacers 224 can be provided on the top surface 222 of the support plate 220 to provide predetermined spacing between adjacent surface tiles that form the elevated building surface. For example, the spacers 224 can be disposed on a crown member that is placed in a recess on the top surface 222 of the support plate 220. In this manner, the crown member can be rotated independent of the support member 216 to adjust the position of the spacers 224.

Figure 6:
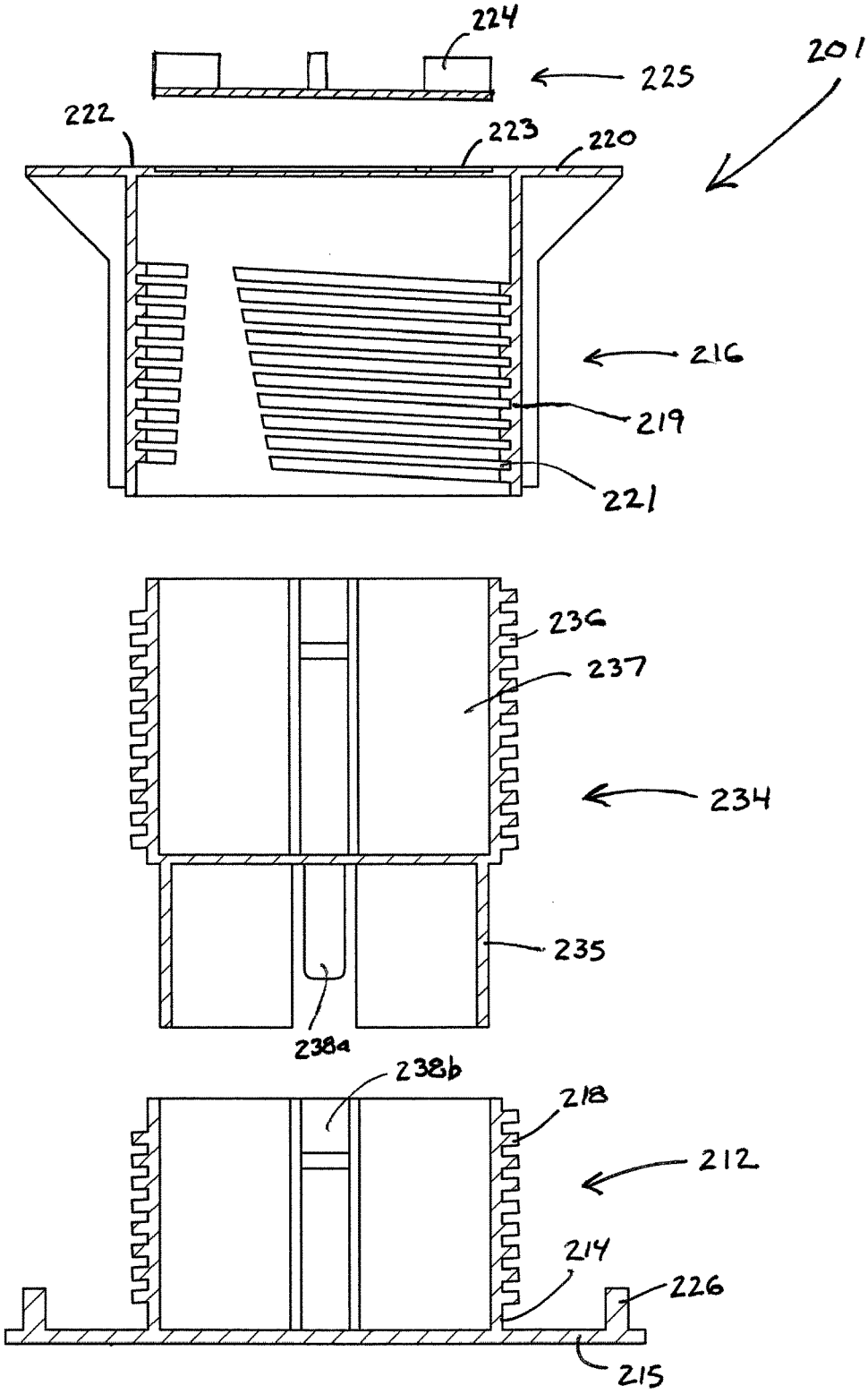
FIG. 6 illustrates a cross-sectional side view of a support pedestal that is useful in a support structure for elevating a building surface.
Figure 7:
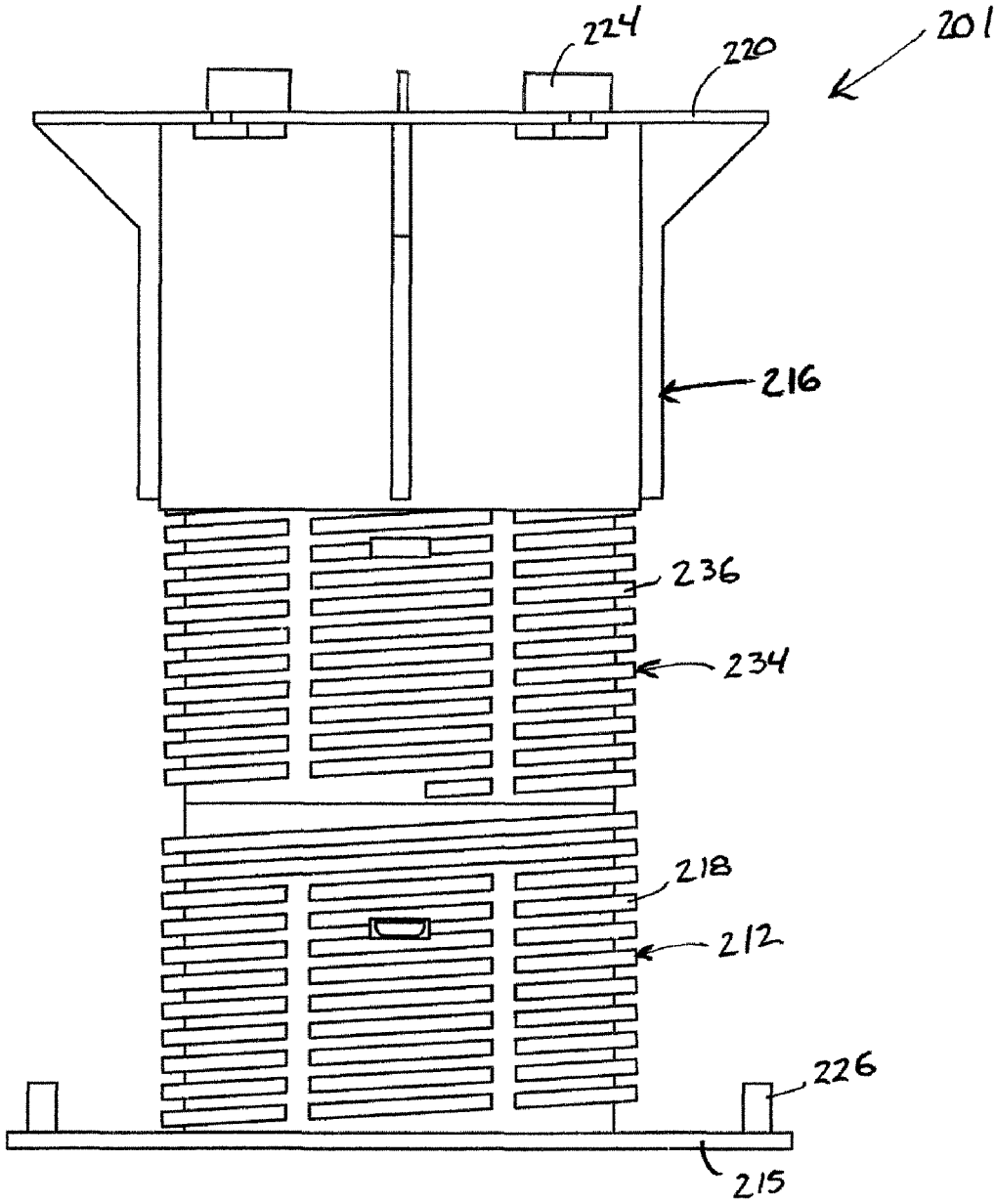
FIG. 7 illustrates a perspective view of a support pedestal that is useful in a support structure for elevating a building surface.

FIG. 6 illustrates a cross-sectional exploded view of another exemplary support pedestal, including an optional coupling member, that can be useful in a support structure, and FIG. 7 illustrates a side view of the assembled support pedestal including the optional coupling member. Referring to FIGS. 6 and 7, the support pedestal 201 includes a base member 212 having a base member plate 215 that is adapted to be placed upon a fixed surface. The base member includes a cylindrical base member extension 214 extending upwardly from the base member plate 215 when the support pedestal 201 is operatively placed on a fixed surface. The base member extension 214 includes base member threads 218 disposed on an outer surface of the base member extension 214.

The support pedestal 201 also includes a support member 216 having a support plate 220 and a cylindrical support member extension 219 that extends downwardly from the support plate 220. A crown member 225 including tile spacers 224 is adapted to be placed in a recess 223 on the top surface 222 of the support member 216. In this manner, after placement of the support pedestal 201, the crown member 225 can be freely rotated in the recess 223 to accommodate the positioning of the surface tiles.

The support member 216 also includes support member threads 221 disposed on an inner surface of the support member extension 219. The support member threads 221 are adapted to rotatably engage the base member threads 218 to directly connect the support member 216 to the base member 212. In this manner, the height of the support pedestal 201 can be adjusted by rotating the support member 216 or the base member 212, relative to the other.

As illustrated in FIGS. 6 and 7, the support pedestal 201 also includes a coupling member 234 that is adapted to increase the height of the support pedestal 201. The coupling member 234 includes a first cylindrical portion 235 that is adapted to slidably engage with the base member extension 214, and includes a second cylindrical portion 237 that includes coupling member threads 236 that are adapted to rotatably engage with the support member threads 221. It is important to note that the timing of the coupler member threads 236 with the base member threads 218 should be synchronized when the coupling member 234 is placed in the base member 212. As a result, the support member threads 221 can fully engage the coupling member threads 236 and continue to thread onto the base member threads 218 without binding. In this way, the support pedestal 201 can be fully adjusted through a wide range of heights without any gaps in the obtainable pedestal height. In the embodiment illustrated in FIGS. 6 and 7, the coupling member 234 also includes an alignment member 238*a* that is adapted to mate with an alignment member 238*b* in the base member 212 to insure the timing of the coupling member threads 236 with the base member threads 218.

Thus, the coupling member 234 can engage both the support member 216 and the base member 212 to couple the support member 216 to the base member 212 and provide an increased height for the support pedestal 201.

The support pedestal 201 also includes attachment knobs 226 disposed around the perimeter of the support pedestal. The attachment knobs 226 are adapted to be placed through apertures in a brace to secure the brace to the support pedestal.

Figure 8:
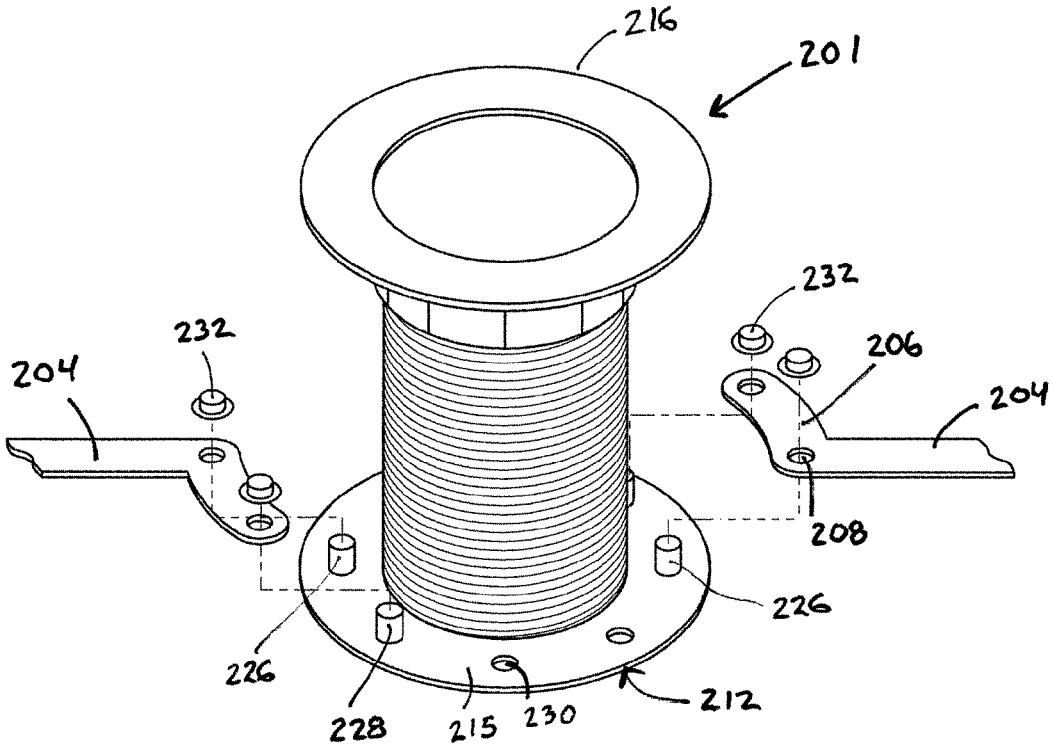
FIG. 8 illustrates a perspective view of a support pedestal and interconnecting braces being placed on the support pedestal and that is useful in a support structure for elevating a building surface.

FIG. 8 illustrates a perspective view of another embodiment of a support pedestal 201 and braces 204 being attached to the support pedestal 201. During installation, the braces 204 can be attached to the base member 212 before or after connecting the support member 216 to the base member 212. After placement of the base member 212 on a fixed surface, an installer can rotate the support member 216 relative to the base member 212 to adjust the height of the support pedestal 201. The base member 212 also includes pedestal attachment elements in the form of attachment knobs 226 and 228 that are disposed around the perimeter of the support pedestal 201. As illustrated in FIG. 8, the attachment knobs 226 and 228 are attached to the base member 212 and project upwardly from the base member plate 215. The attachment knobs 226 and 228 can be integrally molded with the base member 212 during fabrication of the base member. Alternatively, the attachment knobs 226 and 228 can be removably affixed to the base member 212 such as by inserting the attachment knobs through base member apertures 230 during installation. The inclusion of opposed integral knobs 226 and off-set removable knobs 228 can facilitate the molding process for the base member 212, such as when the base member 212 is fabricated by injection molding of a plastic material. However, all of the attachment knobs can be permanent knobs, all of the attachment knobs can be removable knobs, or any combination thereof. Further, the attachment knobs can advantageously provide a grip that can be held by an installer to maintain the base member 212 in a stationary position while the support member 216 is rotated relative to the base member 212, or to rotate the base member 212 while the support member is maintained in a stationary position, to adjust the height of the support pedestal 201.

Brace attachment elements in the form of apertures 208 in the end portion 206 of the braces 204 are placed over attachment knobs 226 and 228 to attach the braces 204 to the base member 212. After attachment of the braces 204, caps 232 can optionally be placed over the top of the knobs 226 and 228 to secure the brace 204 to the base member 212. For example, the caps 232 can frictionally engage the knobs 226 and 228 such that the brace 204 cannot be easily detached from the base member 212.

It will be appreciated from the foregoing that the support structure and the method for the assembly of the support structure provide a rapid means for an installer to interconnect a plurality of support pedestals by attaching and securing braces to the support pedestals during construction of the support structure.

Figure 9:
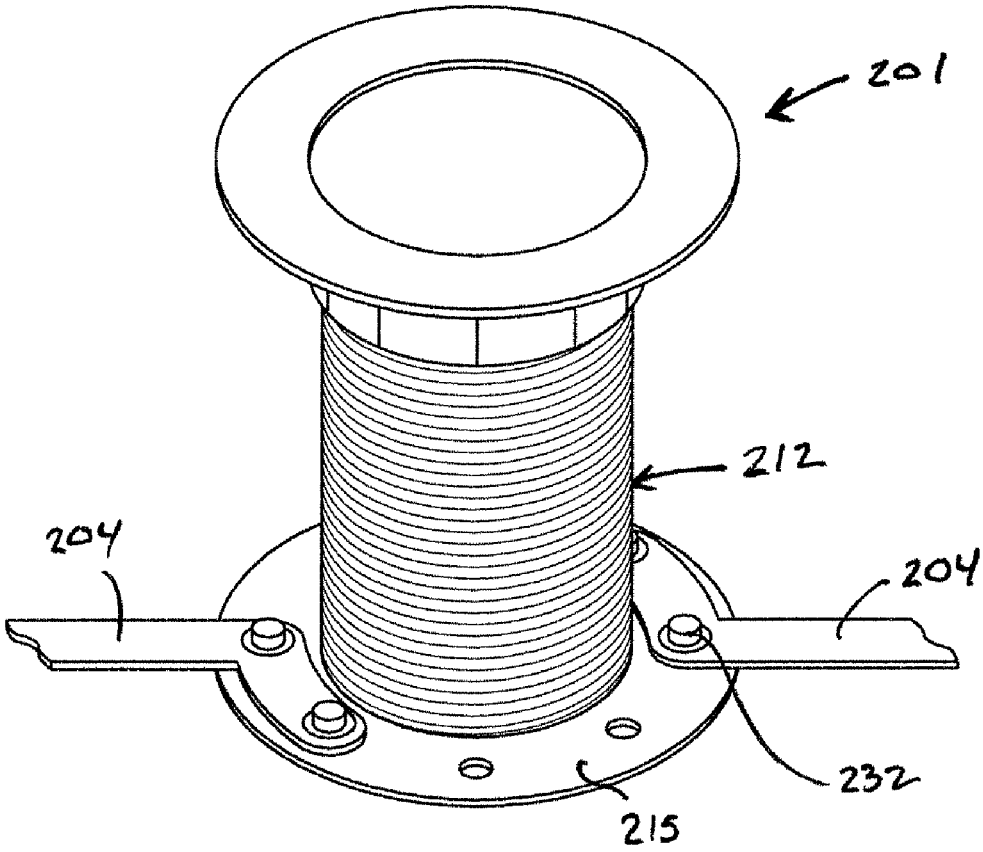
FIG. 9 illustrates a perspective view of a support pedestal having braces attached to the base member of the support pedestal and that is useful in a support structure for elevating a building surface.

FIG. 9 illustrates a perspective view of a support pedestal 201 having two braces 204 attached to the base member 212 of the support pedestal 201. Caps 232 disposed over the knobs in the base member plate 215 secure the braces 204 to the support pedestal 201.

Figure 10:
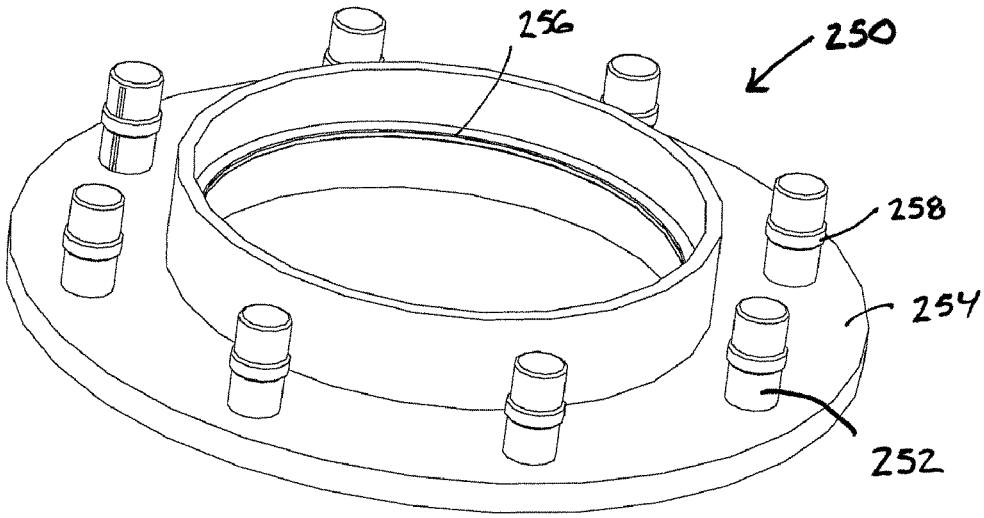
FIG. 10 illustrates a perspective view of a stabilizing collar that is useful as an attachment element in a support structure for elevating a building surface.

In one embodiment, the pedestal attachment elements can advantageously be disposed on a stabilizing collar that is attached to the support pedestal such that the attachment elements are disposed around a perimeter of the support pedestal. FIG. 10 illustrates a perspective view of a stabilizing collar 250 that can be utilized with a support pedestal to provide a means to attach braces to the support pedestal. The stabilizing collar 250 includes a plurality of attachment knobs 252 that are disposed on a flange 254 extending around the perimeter of the stabilizing collar 250. The flange 254 extends substantially orthogonally from a threaded portion 256 of the stabilizing collar. The threaded portion 256 is adapted to be threadably engaged with a support pedestal to attach the stabilizing collar to the support pedestal. In this regard, the braces can include apertures that are adapted to fit over the attachment knobs 252 to secure the braces to the stabilizing collar 250, and hence to attach the braces to the support pedestal.

A retaining element such as a retaining ridge 258 can also be provided to secure the brace after placement of the brace aperture over the attachment knob 252, e.g., so the brace does not inadvertently detach from the attachment knob. Thus, the aperture in the brace can have a diameter that is slightly smaller than the diameter of the retaining ridge so that the brace can be "snap-fit" onto the attachment knob. The retaining ridge 258 can be integrally formed with the attachment knob 252, and the attachment knobs 252 can be permanently or removably affixed to the flange 254. For example, the flange 254 could include apertures and removable attachment knobs could be inserted through the apertures in the flange 254 from the bottom of the flange 254. Alternatively, the attachment knobs 252 may be integrally molded with the flange 254. It will also be appreciated that the stabilizing collar could include attachment elements that are apertures, such as where the braces include similarly configured attachment knobs that are adapted to fit into the apertures.

Figure 11:
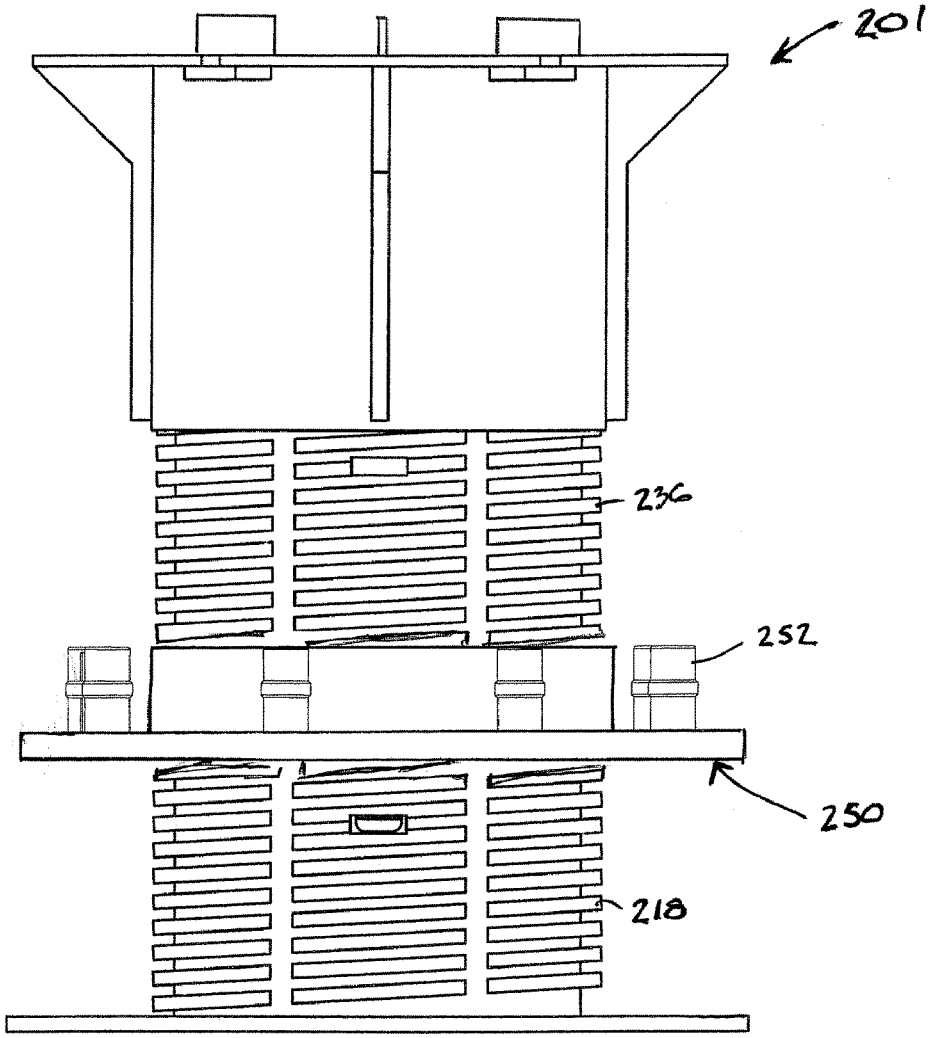
FIG. 11 illustrates a side view of a support pedestal including a stabilizing collar that is useful in a support structure for elevating a building surface.

FIG. 11 illustrates a support pedestal 201 that includes a stabilizing collar 250 that is threadably engaged with the support pedestal, e.g., the support pedestal illustrated in FIG. 7. As a result, the attachment knobs 252 are disposed around the perimeter of the support pedestal 201. It should be noted that when the stabilizing collar 250 is threadably engaged with such a support pedestal 201, the stabilizing collar 250 can advantageously be rotated to move the collar along the base member threads 218 and/or the coupling member threads 236 to adjust the height of the stabilizing collar 250 relative to the surface onto which the pedestal 201 is placed. Such a pedestal support 201 having attachment elements 252 with adjustable height can advantageously provide increased stability, particularly with the increased pedestal support heights that are obtainable using a coupling member. Further, the support collar 250 can be rotated to adjust the positioning of the attachment knobs 252 during installation without necessitating rotation of the entire support pedestal 201.

Figure 12:
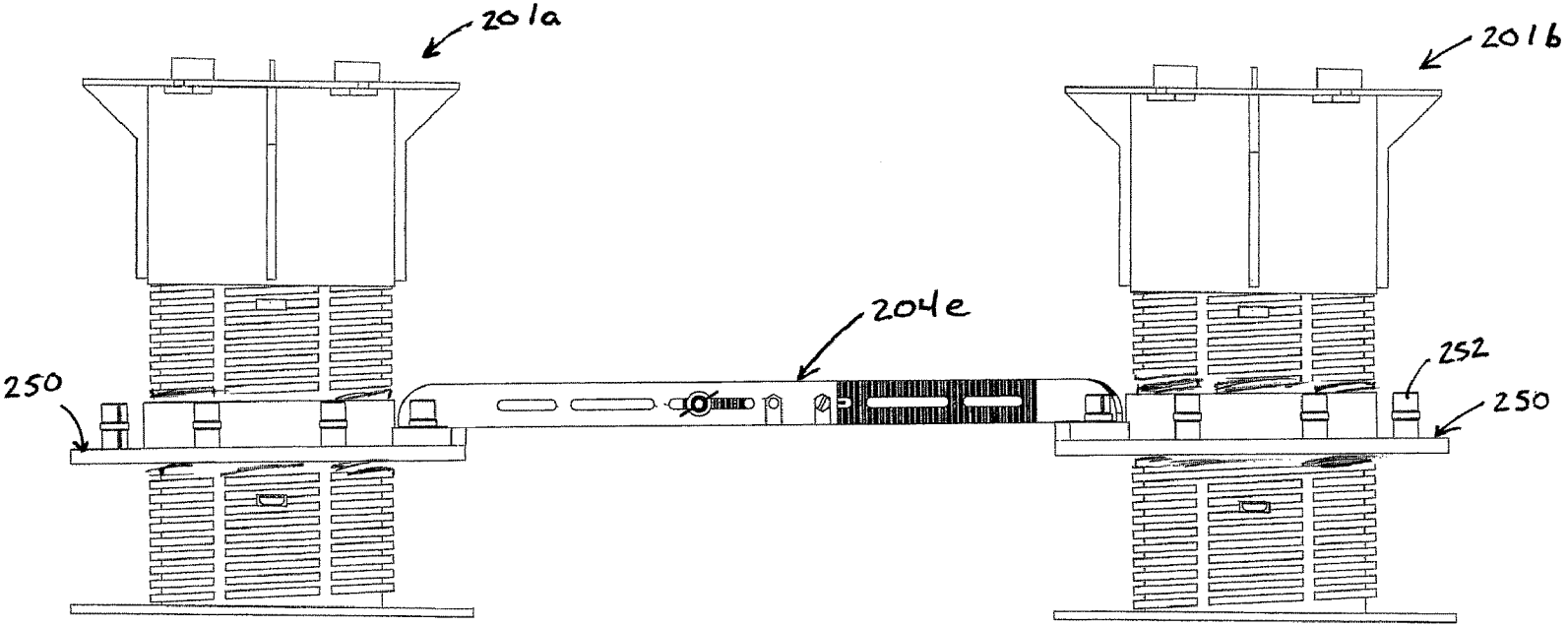
FIG. 12 illustrates an adjustable length brace attached to two support pedestals having stabilizing collars in a support structure for elevating a building surface.

FIG. 12 illustrates two support pedestals 201*a* and 201*b* that include stabilizing collars 250 threadably engaged with the support pedestals and that are both attached to an adjustable length brace 204*e* to interconnect the support pedestals 201*a* and 201*b*. By having the attachment elements (e.g., attachment knobs 252) disposed above the fixed surface and closer to the center of gravity of the support pedestals 201, a more stable support structure can advantageously be formed.

Figure 13:
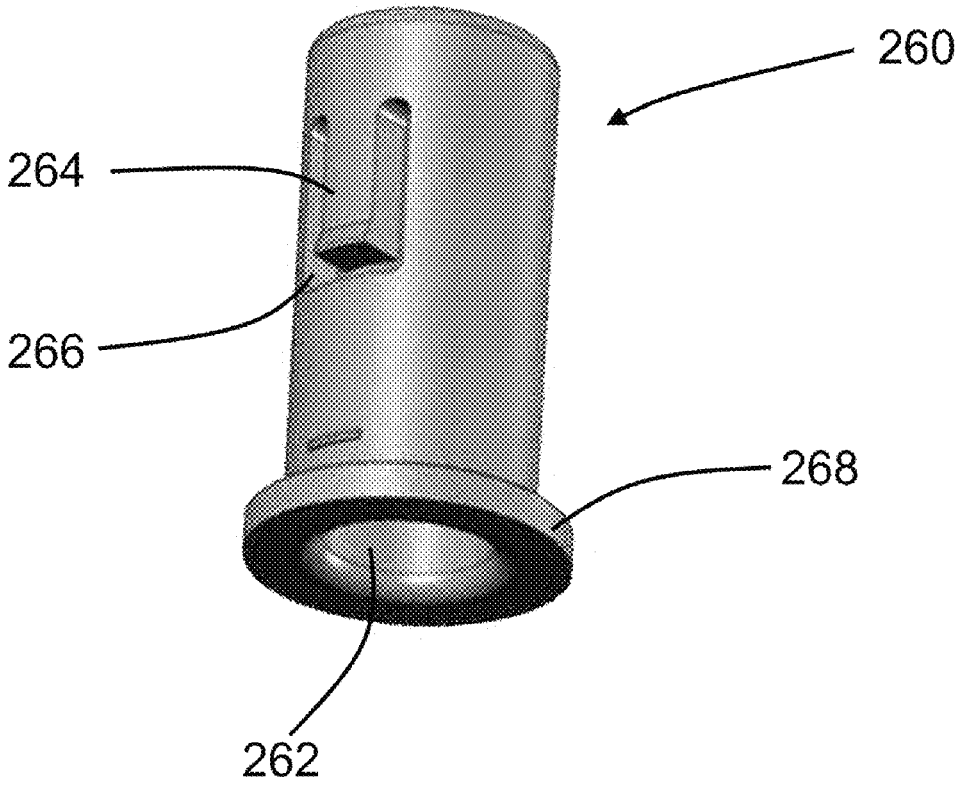
FIG. 13 illustrates a perspective view of an attachment knob that is useful as an attachment element in a support pedestal.

FIG. 13 illustrates an alternative embodiment of an attachment knob 260 that is useful as an attachment element for securing the braces to the support pedestals. The attachment knob 260 includes a hollow interior 262 and a slot 266 formed in the attachment knob 260. A retaining element in the form of a resilient tab member 264 is disposed within the slot 266. In this manner, a mating aperture in a brace can be placed over the attachment knob 260 and pushed downwardly past the resilient tab member 264. The tab member 264 will then snap back into position to secure the brace to the attachment knob 260. Such an attachment knob 260 can be removably attached to a support pedestal (e.g., to a stabilizing collar or a base member) or can be permanently attached.

While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. A support structure for elevating a building surface above a fixed surface, the support structure comprising:

a plurality of support pedestals disposed in spaced-apart relation on a fixed surface, the support pedestals comprising:

a base member that is adapted to be placed upon the fixed surface; and a support plate disposed over the base member;

a plurality of pedestal attachment knobs disposed around the perimeter of the support pedestal, and a plurality of braces, the braces comprising end portions at opposite ends of an elongate central portion, and at least two spaced-apart brace attachment apertures disposed in each of the end portions of the braces, wherein the braces are operatively attached to at least two adjacent support pedestals to interconnect the support pedestals and form a stable support structure by securing the brace attachment apertures to the pedestal attachment knobs such that the pedestal attachment knobs are disposed through the brace attachment apertures; and wherein at least one of said at least two spaced-apart brace attachment apertures is offset relative to an axis of the elongate central portion of the brace.

2. A support structure as recited in claim 1, wherein the support pedestals have a fixed pedestal height.

3. A support structure as recited in claim 1, wherein the support pedestals have an adjustable pedestal height.

4. A support structure as recited in claim 1, wherein the end portions of the braces comprise arcuate end portions.

5. A support structure as recited in claim 4, wherein the at least two spaced-apart brace attachment apertures are disposed through the arcuate end portions of the braces.

6. A support structure as recited in claim 1, wherein the braces have an adjustable length.

7. A support structure as recited in claim 1, wherein the base members comprise a base member plate that is adapted to be placed upon a fixed surface and wherein the pedestal attachment knobs are disposed around a perimeter of the base member plates.

8. A support structure as recited in claim 7, wherein at least a portion of the pedestal attachment knobs are removably affixed to the base member plate.

9. A support structure as recited in claim 1, wherein the pedestal attachment knobs are disposed on a stabilizing collar that is operatively attached to the support pedestal.

10. A support structure as recited in claim 1, wherein the support pedestals are not attached to the fixed surface.

11. A support structure as recited in claim 1, wherein the support pedestals are plastic support pedestals.

12. A support structure as recited in claim 1, wherein the braces are fabricated from a material selected from the group consisting of plastic, wood, and composites.

13. A support structure for elevating a building surface above a fixed surface, the support structure comprising:

a plurality of height-adjustable support pedestals disposed in spaced-apart relation, the pedestals comprising:

a base member comprising a base member plate that is adapted to be placed upon a fixed surface; and a support plate disposed over the base member that is adapted to support a surface tile above the fixed surface;

a plurality of pedestal attachment knobs operatively disposed around the perimeter of the support pedestal, and a plurality of braces operatively attached to the support pedestals to interconnect the support pedestals, the braces comprising arcuate end portions at opposite ends of an elongate central portion, the arcuate end portions having at least two spaced-apart brace attachment apertures, wherein the attachment knobs are disposed within the brace attachment apertures to secure the braces to the support pedestals; and wherein at least one of said at least two spaced-apart brace attachment apertures is offset relative to an axis of the elongate central portion of the brace.

14. A support structure as recited in claim 13, wherein the pedestal attachment knobs are disposed around a perimeter of the base member plate.

15. A support structure as recited in claim 13, wherein the height-adjustable support pedestals comprise a support member comprising the support plate, where the support member is threadably connected to the base member.

16. A support structure as recited in claim 15, wherein the height-adjustable support pedestals further comprise a coupling member operatively connecting the base member and the support member.

17. A support structure as recited in claim 15, wherein the pedestal attachment knobs are disposed on a stabilizing collar that is threadably attached to the support pedestal.

18. A support pedestal as recited in claim 13, wherein the braces have an adjustable length.

19. A support pedestal as recited in claim 13, wherein the pedestal attachment knobs comprise a retaining element adapted to retain the brace on the pedestal attachment knobs.

20. An elevated building surface assembly, comprising:

a plurality of support pedestals disposed in spaced-apart relation, the support pedestals comprising a base member having a base member plate that is adapted to be placed upon a fixed surface and a support member disposed over and threadably connected to the base member;

a plurality of braces, the braces being attached to adjacent support pedestals to interconnect the support pedestals to form a support structure; and a plurality of surface tiles placed upon the support members to form an elevated building surface, wherein the braces comprise end portions at opposite ends of an elongate central portion, and at least two spaced-apart brace attachment apertures disposed in each of the end portions of the braces, the brace attachment apertures being placed over pedestal attachment knobs that are operatively disposed around the perimeter of the support pedestals to operatively connect adjacent support pedestals and form a stable support structure; and wherein at least one of said at least two spaced-apart brace attachment apertures is offset relative to an axis of the elongate central portion of the brace.

21. An elevated building surface assembly as recited in claim 20, wherein the pedestal attachment knobs are disposed on a stabilizing collar that is threadably connected to the support pedestal.

22. An elevated building surface assembly as recited in claim 20, wherein the pedestal attachment knobs are disposed around a perimeter of the base member plate.

23. An elevated building surface assembly as recited in claim 20, wherein the braces have an adjustable length.

* * * * *